US007452460B2

(12) United States Patent
Blake

(10) Patent No.: US 7,452,460 B2
(45) Date of Patent: Nov. 18, 2008

(54) LEAF AND DEBRIS CATCHER

(76) Inventor: Michael N. Blake, 5102 Cleiws Ave., Tampa, FL (US) 33610

( * ) Notice: Subject to any disclaimer, the term of this patent is extended or adjusted under 35 U.S.C. 154(b) by 126 days.

(21) Appl. No.: 11/672,505

(22) Filed: Feb. 7, 2007

(65) Prior Publication Data

US 2007/0181476 A1 Aug. 9, 2007

Related U.S. Application Data

(63) Continuation-in-part of application No. 11/348,445, filed on Feb. 7, 2006, now Pat. No. 7,374,671.

(51) Int. Cl.
*B01D 35/00* (2006.01)

(52) U.S. Cl. ..... 210/167.19; 210/232; 210/470; 4/496

(58) Field of Classification Search ..... 210/167.1, 210/167.19, 232, 470, 136; 4/496
See application file for complete search history.

(56) References Cited

U.S. PATENT DOCUMENTS 3,263,811 A * 8/1966 Baker et al. ..... 210/136
3,625,364 A 12/1971 La Chance
4,053,412 A 10/1977 Stix
4,068,327 A 1/1978 Heinlein
4,089,074 A 5/1978 Sermons
4,332,683 A 6/1982 Alt
4,455,695 A 6/1984 Mikhel
4,746,424 A * 5/1988 Drew ..... 210/167.2
4,781,827 A 11/1988 Shields
4,950,393 A 8/1990 Goettl
5,173,181 A 12/1992 McFarland
5,264,122 A 11/1993 Lakotish
5,277,801 A 1/1994 Lundquist
5,279,728 A 1/1994 Weiss
5,288,414 A 2/1994 Mongiello (Continued)

FOREIGN PATENT DOCUMENTS

WO WO 2004/042173 A1 5/2004

OTHER PUBLICATIONS

"Aqua Genie Swimming Pool Skimmer," website: http://www.poolwarehouse.com/Aqua-Genie-Skimmer.html, 5 pages, printed from the Internet on Dec. 15, 2005.

(Continued)

*Primary Examiner*—Fred Prince
(74) *Attorney, Agent, or Firm*—Christopher Wood; Wood & Eisenberg, PLLC

(57) ABSTRACT

A leaf and debris catcher for removing leaves and/or debris from a body of water. The leaf and debris catcher includes a leaf and debris collection member having top, bottom, front, rear, first, and second sides, the bottom side defining an interior side. A female vertical stem extends from a central location on the interior side of the bottom side, the stem defining a bore having opposite open ends. At least one inward opening front flap is located at the front side of the leaf and debris collection member. A plurality of debris and leaf guides converge and extend from the at least one front flap. The first and second sides of the leaf and debris collection member define a plurality of male tongues, and the top and bottom sides define complementary female slots, which are aligned such that the tongues snap-fit into the complementary female slots.

5 Claims, 8 Drawing Sheets

U.S. PATENT DOCUMENTS

| | | | | |
|---|---|---|---|---|
| 5,350,508 | A | | 9/1994 | Van der Watt |
| 5,443,723 | A | * | 8/1995 | Stankowski et al. .... 210/321.75 |
| 5,454,940 | A | | 10/1995 | Lakotish |
| 5,487,830 | A | | 1/1996 | Huppert |
| 5,536,397 | A | | 7/1996 | D'Offay |
| 5,759,388 | A | | 6/1998 | Cote |
| 5,788,850 | A | | 8/1998 | Tuomey |
| 5,833,845 | A | | 11/1998 | Anderson |
| 5,849,184 | A | | 12/1998 | Veillet |
| 5,919,359 | A | | 7/1999 | Bisseker |
| 6,041,453 | A | | 3/2000 | Barrow et al. |
| 6,063,270 | A | | 5/2000 | d'Offay |
| 6,270,683 | B1 | | 8/2001 | Turner |
| 6,398,952 | B1 | | 6/2002 | Baer |
| 6,962,257 | B2 | | 11/2005 | Upchurch et al. |
| 2005/0011819 | A1 | | 1/2005 | Gillen et al. |

OTHER PUBLICATIONS

"Dragonfly Super Skimmer," website: http://www.abc.net.au/newinventors/txt/s1093763.htm, 4 pages, printed from the Internet on Dec. 15, 2005.

"Brand New Skimzit Automatic All Swimming Pool Skimmer," website: http://cgi.ebay.ca/BRAND-NEW-SKIMZIT-AUTOMATIC-ALL-SWIMMING-POOL-SKIMMER_WOQQitemZ4423316801QQcategoryZ66782QQcmdZViewItem, 15 pages, printed from the Internet on Dec. 15, 2005.

"New Kreepy Krauly Pool Cleaner Leaf Trap Canister," website: http://cgi.ebay.com/ws/eBayISAPI.dll?ViewItem&item=4410669497&category=66782, 6 pages, printed from the Internet on Dec. 15, 2005.

* cited by examiner

LEAF AND DEBRIS CATCHER

CROSS-REFERENCE TO RELATED APPLICATIONS

This application claims the benefit of priority to, and is a continuation-in-part of, application Ser. No. 11/348,445, filed Feb. 7, 2006, now U.S. Pat. No. 7,374,671, the disclosure of which is expressly incorporated by reference herein in its entirety.

FIELD OF THE INVENTION

The present invention relates to leaf and debris catching devices and more specifically to a leaf and debris catcher that removes leaves and debris from water such as water found in swimming pools and water fountains.

DESCRIPTION OF THE RELATED ART

Families, park recreation services, condo and apartment complexes frequently have outdoor swimming pools that require maintenance and cleaning. Spending time cleaning a pool is less fun than using the pool. Thus, there is a need for cleaning devices that help remove leaves and debris that accumulate in swimming pools. Likewise, there is a need for devices that help remove leaves and debris that accumulate in water fountains.

Several efforts have been made to address removing debris and leaves from pools and/or water fountains. U.S. Pat. No. 6,041,453, issued Mar. 28, 2000 to Barrow et al., describes a jet directed debris skimmer for floating adjacent the surface of a pool to entrap floating debris including leaves. The '453 skimmer includes a floway having a front and a rear, with an entrance lip at the front, and a receptacle receiver at the rear.

U.S. Pat. No. 4,332,683, issued Jun. 1, 1982 to Alt, describes an adjustable and stationary holding apparatus for a swimming pool surface skim net comprising an elongated hollow main member provided with at least one hole at the top surface and coupled to at least one support foot member for support. The elongated hollow main member is connected to a skim net holding member to which the skim net is displaceably coupled. A skim net support member is coupled to the skim net to maintain the skim net in a fully expanded position.

U.S. Pat. No. 4,781,827, issued Nov. 1, 1988 to Shields, describes a portable swimming pool skimmer. The '827 skimmer can be positioned at any point along the periphery of a swimming pool. The portable skimmer includes a weighted base member from which extends in an outward and downward direction a bracket for holding a skimmer basket. The bracket is vertically adjustable so that the skimmer basket is positioned slightly below the water surface to allow a skimming action. At the bottom of the basket, a fitting to which one end of a pool hose may be attached is provided. The other end of the pool hose is attached to a suction line from the pool pump and filter assembly, which suction line may be a part of a built in skimmer or another hose from the built in skimmer to another device, such as an automatic pool cleaner. In the latter situation, a restriction in the skimmer hose is provided to minimize the suction pressure, which operates the pool-cleaning device. A debris guide is also provided to direct the floating debris towards the basket and is selectably positioned by the user in response to the current direction of the pool water. The bracket holding the skimmer basket is fabricated from tubular material and holes are provided in the tubular material to allow water to enter and prevent the bracket from floating.

U.S. Pat. No. 5,454,940, issued Oct. 3, 1995 to Lakotish, describes a pool cleaner and method for removing debris from the surface of a pool. The '940 pool cleaner is said to comprise a body having an open first end, open body sides, and a filtration second end, the body being generally hollow to form a conduit for water and having a water supply member which may be operably connected to a source of pressurized water. The body is supported by support means so that the body does not substantially interfere with the circulation of water through the open first end, the open body sides, or the filtration second end. A filter net is attached to the filtration second end of the body and one or more water jets are operably connected to the body for propelling water substantially toward the filter net to direct debris into the filter net.

U.S. Publication No. 20050011819, published Jan. 20, 2005 to Gillen, describes a static pool skimmer. In a preferred embodiment, the static pool skimmer is adapted to attach to a swimming pool railing and float on the surface of the water, collecting surface debris carried by a current.

None of the above inventions and patents, taken either singly or in combination, is seen to describe the instant invention as claimed.

SUMMARY OF THE INVENTION

A leaf and debris catcher for removing leaves and/or debris from a body of water. The leaf and debris catcher includes a leaf and debris collection member having top, bottom, front, rear, first, and second sides, the bottom side defining an interior side. A female vertical stem extends from a central location on the interior side of the bottom side, the stem defining a bore having opposite open ends. At least one inward opening front flap is located at the front side of the leaf and debris collection member. A plurality of debris and leaf guides converge and extend from the at least one front flap. The first and second sides of the leaf and debris collection member define a plurality of male tongues, and the top and bottom sides define complementary female slots, which are aligned such that the tongues snap-fit into the complementary female slots.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to debris catching devices and more specifically to a leaf and debris catching device that aids in the removal of leaves and debris from water such as water found in swimming pools and water fountains.

Figure 1:
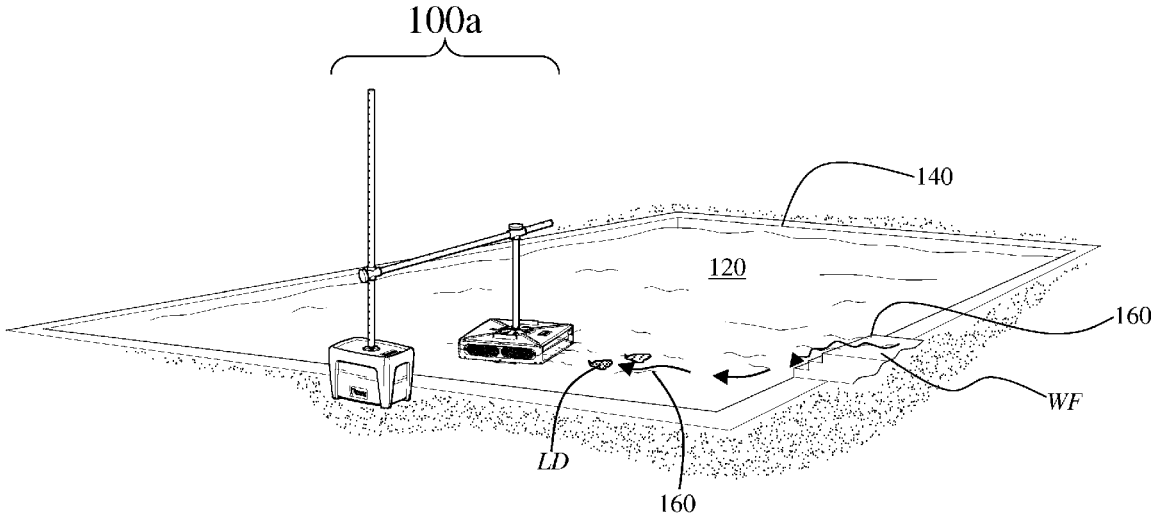
FIG. 1 is an environmental view of a leaf and debris catcher 100*a* according to the present invention.

FIG. 1 shows an environmental, perspective view of a leaf and debris catcher 100*a* according to the invention. The leaf and debris catcher 100*a* is shown collecting leaf or debris from a body of water 120 in an in-ground swimming pool 140 and, more particularly, from water flow represented by arrows 160. The leaf and debris catcher 100*a* functions by taking advantage of water flow, and more particularly, leaves and debris (represented by the alpha-numeric label "LD") carried along in the water flow 160. In this example, a waterfall WF generates the water flow 160.

Figure 2:
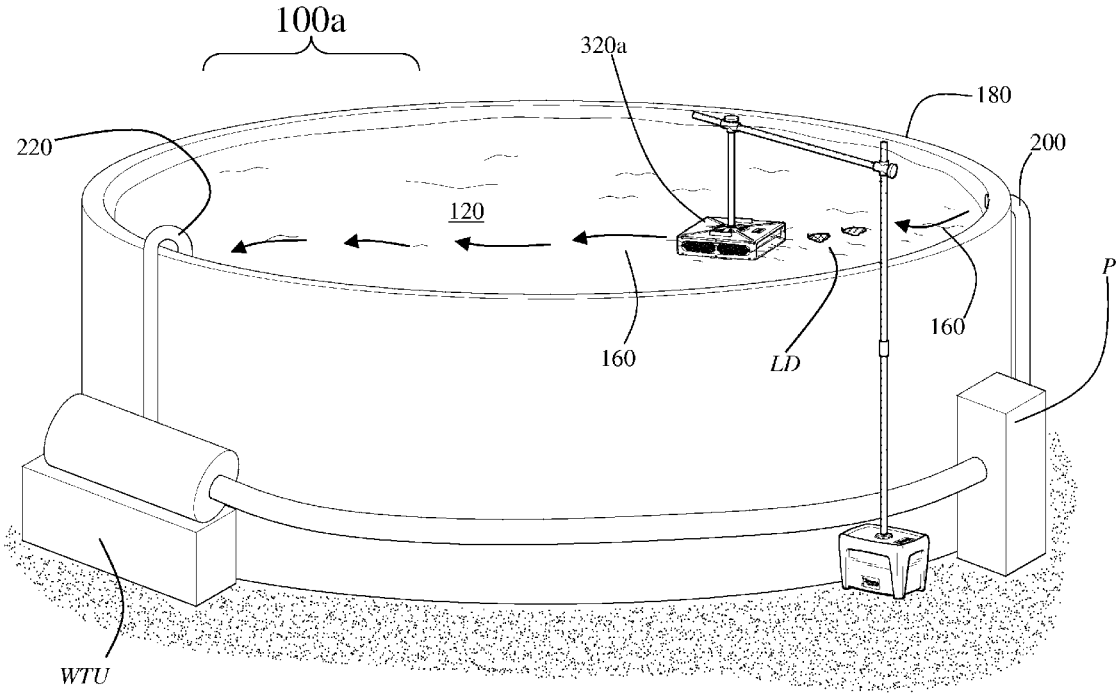
FIG. 2 is a further environmental view of the leaf and debris catcher 100*a* of FIG. 1.

FIG. 2 shows an environmental, perspective view of the leaf and debris catcher 100*a* according to the invention. The leaf and debris catcher 100*a* is shown collecting leaf or debris from a body of water 120 in an above ground swimming pool 180 and, more particularly, from water flow 160. The leaf and debris catcher 100*a* functions by taking advantage of water flow, and more particularly, leaves and debris LD carried along in the water flow 160 directed from a swimming pool water outlet 200.

Still referring to FIG. 2, swimming pool water is typically re-circulated to add water treatment agents such as chlorine-based compounds to keep the water safe and hygienic for swimmers. A pump P typically pumps water from a swimming pool via a water intake 220, thence through a water treatment unit (represented by the alpha-numeric label "WTU") to provide chemically treated water that is returned to the swimming pool through the water outlet 200. A flow of water 160 is typically generated in the swimming pool water 120 adjacent to the water outlet 200 and the water intake 220. The leaf and debris catcher 100*a* is positioned by the swimming pool owner or operator to take advantage of such water currents to remove debris and leaves LD from the swimming pool water 120. Thus, the leaf and debris catcher 100*a* is designed to take advantage of an outgoing jet of water emerging from, for example, a water outlet in a swimming pool. The leaf and debris catcher 100*a* can also be used to remove leaves and debris LD from a water fountain, wherein the leaf and debris catcher 100*a* is positioned to remove leaves and debris from water flows generated by the water fountain.

Figure 3:
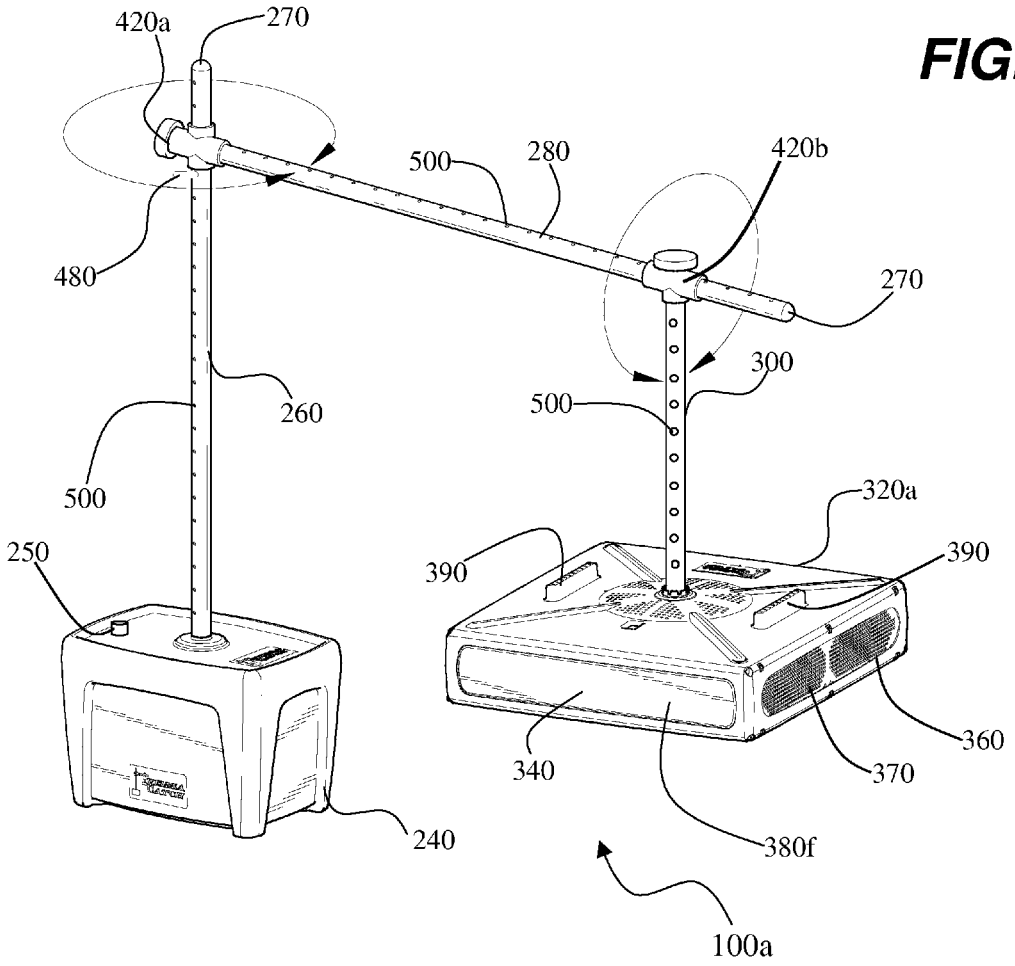
FIGS. 3 through 5 are further perspective views of the leaf and debris catcher of FIG. 1.
Figure 4:
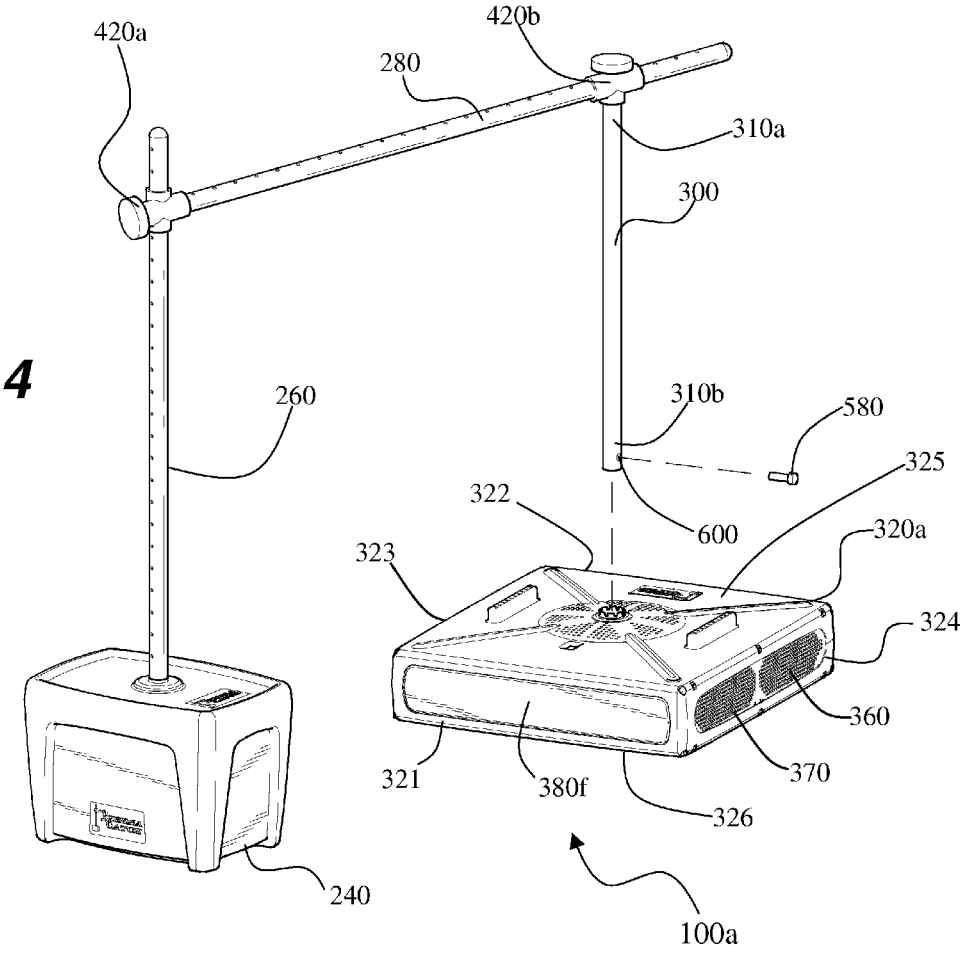
Figure 5:
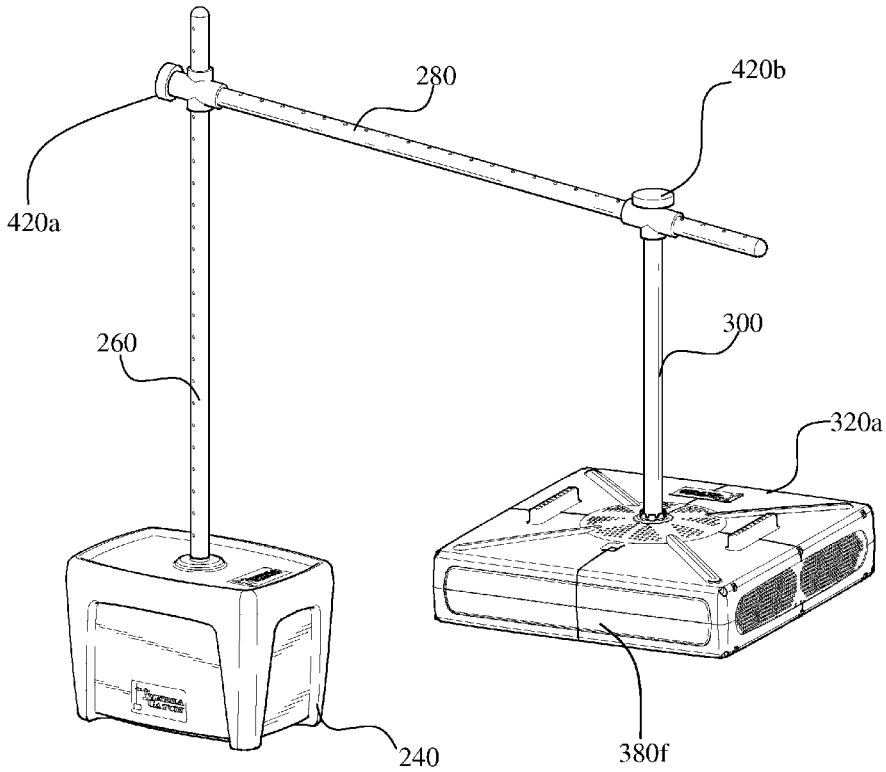

Referring to FIGS. 3, 4 and 5, the leaf and debris catcher 100*a* comprises a base 240, a first vertical support member 260, a horizontal support member 280, a second vertical support member 300, and a leaf and debris collection member 320*a*. The leaf and debris collection member 320*a* has a front end 321, rear end 322, first and second sides 323 and 324, top and bottom sides 325 and 326. In one embodiment, the top and bottom sides 325 and 326 are essentially identical (see FIG. 8).

The base 240 can be essentially hollow and prior to use filled by the operator with sand or water via a removable cap 250; objects can also be put or laid across the base such as one or more sandbags (not shown). Alternatively, the base 240 is pre-filled in the factory with any suitable filler such as, but not limited to, sand or small stones. The leaf and debris collection member 320*a* can take any suitable shape such as a generally rectangular box shape, as shown in FIG. 3. However, it should be understood that the leaf and debris collection member 320*a* could be any shape and possess any set of suitable dimensions (height, width, length) so long as it is capable of removing leaves and debris from water flowing into and through member 320*a*. Optional cap ends 270 can be used to seal opens ends in members 260, 280 and 300. If used, the cap ends 270 can be made out of any suitable material such as, but not limited to, rubber.

The leaf and debris collection member 320*a* comprises at least one water flow inlet member 340 and at least one strainer member 360. The at least one strainer 360 ensures that leaves and solid debris collect and remain inside the leaf and debris collection member 320*a*. In FIG. 3, the at least one water flow inlet member 340 is represented by at least one front flap 380*f* (shown in open state in FIGS. 1 and 2), and the at least one strainer 360 is represented by at least one leaf sieve 370. The at least one front flap 380*f* preferably open inwards in response to water flow pressure thereby allowing water flow containing leaf and debris to flow into the leaf and debris collection member 320*a*.

It should be understood that the at least one water flow inlet member 340 can take any suitable form that allows water to flow into the leaf and debris collection member 320*a*. Similarly, the at least one strainer 360 can take any suitable form, such as, but not limited to: a grill, netting, and any combination thereof. Optional handles 390 can be fitted to the leaf and debris collection member 320*a*.

Figure 6:
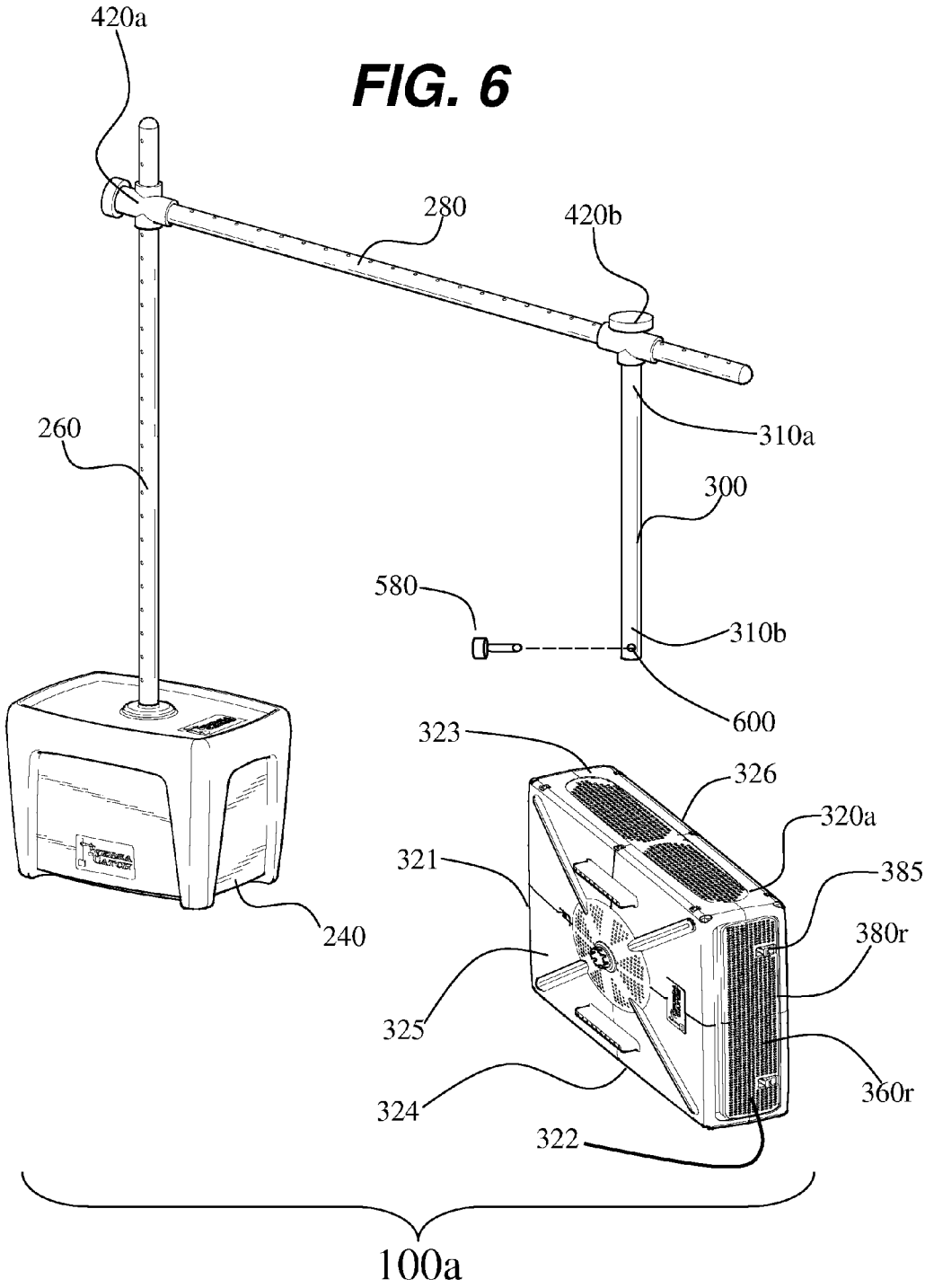
FIG. 6 shows a leaf and debris catcher according to the present invention.
Figure 8:
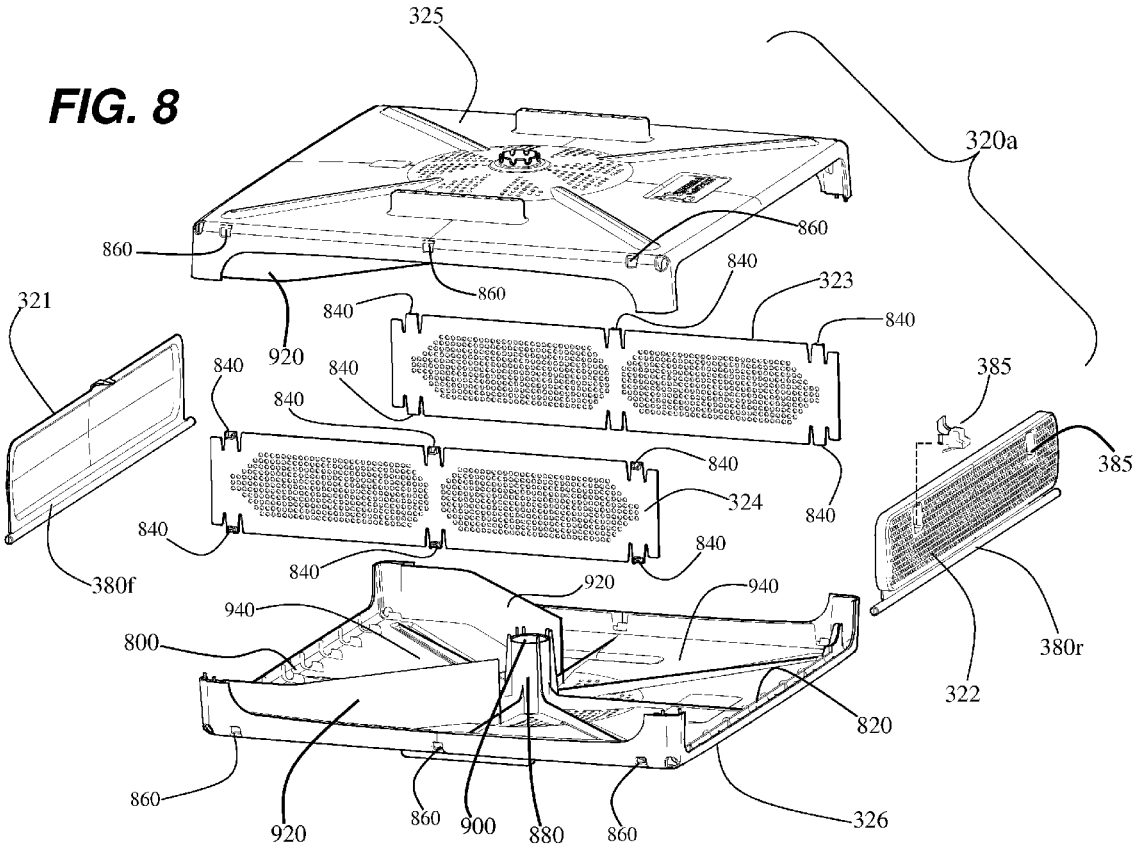
FIG. 8 shows an exploded view of a leaf and debris catcher according to the present invention.

The leaf and debris collection member 320*a* could be fitted with at least one rear flap 380*r* (see, e.g., FIG. 8). If fitted, the at least one rear flap 380*r* can take the form of a flap comprising a sieve (represented by alphanumeric label 360*r* in, for example, FIG. 6). The at least one rear flap 380*r* can open inwards or outwards, but preferably opens outwards, to allow an operator easy access to remove leaf and other debris from inside the leaf and debris collection member 320*a*. If fitted, the at least one rear flap 380*r* can be fastened shut using at least one rear flap latch 385 (see, e.g., FIG. 6).

Any suitable release and securing mechanism can be used to release and secure the leaf and debris collection member 320*a* from the second vertical support member 300. The second vertical support member 300 has proximal and distal ends 310*a* and 310*b*, respectively (see FIG. 4). Typically, the proximal end 310*a* is attached to, and extends downward from, the horizontal support member 280, and the distal end 310*b* passes through the debris collection member 320*a* whereupon the debris collection member 320*a* is affixed to the second vertical support member 300. For example, a bolt 580 could be used to secure debris collection member 320*a* to the distal end 310*b*; the bolt can be secured in a bolt-receiving aperture 600 located at distal end 310*b* (see FIG. 4). The terms "attached to" and "connected to" are regarded herein as equivalent terms.

Right-angle couplers 420*a* and 420*b* are used to attach the first and second vertical members 260 and 300 to opposite ends of the horizontal member 280 as shown, for example, in FIG. 3. Right-angle coupler 420*a* allows the operator to adjust the position of horizontal member 280 with respect to first vertical member 260. Right-angle coupler 420*b* allows the operator to adjust the position of second vertical member 300 with respect to horizontal member 280. Right-angle couplers 420*a* and 420*b* can be made to resemble in appearance control dials or handles on gas stoves as shown in FIG. 3. It should be understood, however, that any suitable right-angle connector could be used. A non-limiting example of a right-angle coupler is shown in FIG. 9 in U.S. Pat. No. 5,259,690, issued Nov. 9, 1993 to Legge; the Legge patent is incorporated by reference in its entirety.

Figure 7A:
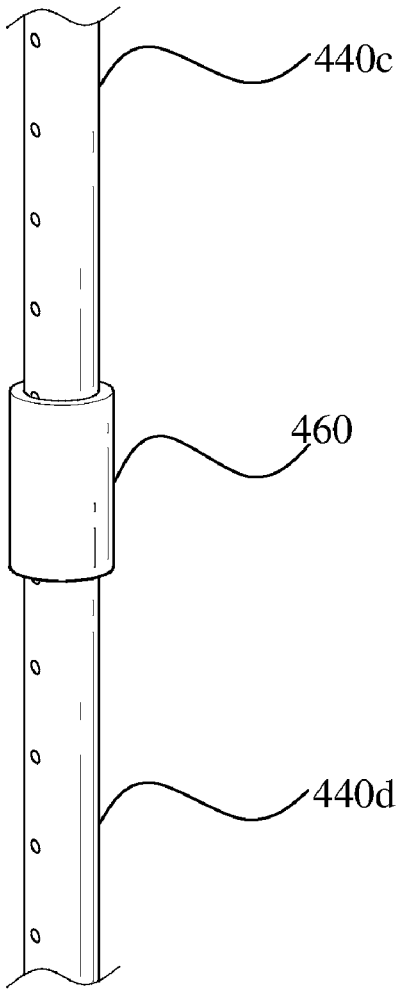
FIG. 7 shows tube sections according to the present invention.
Figure 7B:
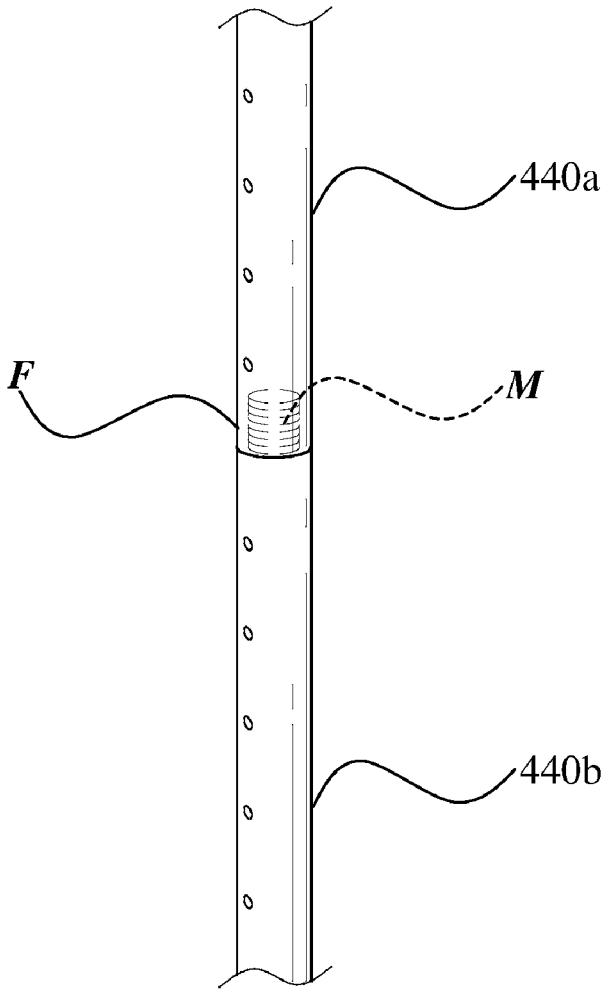

The members 260, 280 and/or 300 can be made up of sections such as, but not limited to, sections of tubing 440. In one embodiment (see FIG. 7B) the sections of tubing 440 each have an opposite end that is female F and the other opposite end is male M such that the male end M of one section of tubing 440*a* fits into the female end F of another section of tubing 440*b* thereby joining sections of tubing 440 in series end-to-end. The first and second vertical support members 260 and 300, and the horizontal support member 280 can be made of, for example, interchangeable lengths of plastic, metal (such as, but not limited to, aluminum or aluminum based alloy), or plastic coated metal tubing or indeed any other suitable material.

Also, a coupler such as a sleeve coupler 460 (see FIG. 7A) can be used to adjoin two sections of tubing 440 (represented by alpha-numeric labels "440*c*" and "440*d*") end-to-end. If used, sleeve coupler 460 may take any suitable form. Sleeve coupler 460 can take a form the same or similar to that shown in FIG. 17 in U.S. Pat. No. 5,259,690, issued Nov. 9, 1993 to Legge. Instead of using a hand lever 13 described in the Legge patent, the sleeve coupler 460 or right-angle coupler 420*a* can be held in place by a bolt or pin 480 inserted into a selected aperture 500 (see FIG. 3). In the alternative, the sections 440 can take the form of tapered tubes like that used by Better Sleep Inc. in their Deluxe Tension Pole Caddy (Model 7286SN). Better Sleep Inc. is located at: 80 Industrial Road, Berkeley Heights, N.J. 07922.

It should be understood that any other suitable coupling means could be used to couple the sections of tubing 440 end-to-end. For example, the tubing coupler described in U.S. Pat. No. 2,473,388, issued Jun. 14, 1949 to I. G. Rambo, can be used to couple tubing sections 440 end-to-end; U.S. Pat. No. 2,473,388 is incorporated herein by reference in its entirety. It should also be understood that the sections of tubing 440 can have a generally square or rectangular cross-section. Stated more explicitly, sections of tubing 440 are expressly not limited to sections of tubing having a generally circular cross-section.

It should also be understood that the horizontal support member 280 and/or second vertical support member 300 are optionally made up of same sections 440 used to make up first vertical support member 260 thus enabling a human operator to add sections end-to-end to lengthen or shorten horizontal support member 280. Therefore, the sections that make up member 280 can also make use of, for example: one or more sleeves 460, the tubing coupler described in U.S. Pat. No. 2,473,388, the sleeve coupler shown in FIG. 17 in U.S. Pat. No. 5,259,690, the tapered tubes like that used by Better Sleep Inc. in their Deluxe Tension Pole Caddy (Model 7286SN), alone or in combination.

The sections of tubing can be any suitable length and diameter. For example, sections can be about 2 to 4 feet in length such as 2 feet sections with a diameter of about 0.5 to 2.5 inches. The height of the first vertical support member 260 can vary, e.g., could include a single 4 to 7 feet section; 4 feet in length made up of two 2 foot sections of tubing; 6 feet in length made up of two 3 foot sections or three 2 foot sections of tubing; 7 feet in length made up of, for example, three 2 feet sections and one 1 foot section of tubing, and so on. Likewise for the horizontal member 280 and the second vertical member 300. There is no standard lengths of measurement, any suitable number of sections of tubing from, for example, one to 5 sections of tubing may be used; the actual dimensions of the members 260, 280 and 300 can vary according to the size of swimming pool or waterfall, and position of the outlet 200 or direction of water flow 160.

Similarly, the dimensions of the leaf and debris collection member 320*a* can vary without detracting from the spirit of the invention. For example, the dimensions of member 320*a* can be approximately one to three feet in length, one to three feet in width, and about 0.5 to about 1.5 feet in height. For example, the member can have the following non-limiting dimensions: three feet in length, two feet six inches in width and ten inches in height.

In one non-limiting example, the base is approximately 2 feet in length, 1 foot wide and about 1 foot high. However, the base can have any suitable shape and possess any set of suitable dimensions as would be understood by a person of ordinary skill in the art.

The components that make up the leaf and debris catcher 100*a* may be made of plastics or metal, or a combination of both plastics and metal. More than one material may be used in an individual component. For example, members 260, 280 and/or 300 can be made up of tube sections 440 (see FIGS. 7A and 7B), which in turn can be made of plastic alone, or a combination of plastic and metal such as light alloy tubes with a plastic coat. The members 260, 280 and/or 500 define optional apertures 500. Optional apertures 500 can be used to position members 420*a*, 420*b*, and hold member 320*a* in place attached to second vertical support member 300.

The first vertical member 260 can be made of separate sections that join end-to-end or might be a single section of tubing with any suitable cross-section (CS) such as, but not limited to, circular CS, a rectangular CS, a regular polygonal CS, an irregular polygonal CS, a square CS.

Referring to FIG. 8, which shows an exploded view of the leaf and debris collection member 320*a*. Front and rear ends 321 and 322 are assembled by respectively fitting into slots 800 and 820 located at opposite ends of bottom side 326. First and second sides 323 and 324 each define a plurality of male tongues 840. Top and bottom sides 325 and 326 define complementary female slots 860. Male tongues 840 and female slots 860 are aligned such that tongues 860 snap-fit into the complementary female slots 860 located on the top and bottom sides 325 and 326. One of the latches 385 is shown separately in FIG. 8.

Still referring to FIG. 8, bottom side 326 defines interior side 940. A female vertical stem 880 is located in a central location on the interior side 940 of bottom side 326. The female vertical stem 880 defines bore 900; bore 900 has opposite open ends. The bore 900 is sized to accommodate end 310*b* of second vertical support member 300 (see FIG. 4). A plurality of optional debris and leaf guides 920 extend from the at least one front flap 380*f*. The guides 920 converge inwards but do not touch.

In one embodiment, the first 260 and second 300 vertical support members, and the horizontal support member 280 have at least one cross-section alone or in combination selected from the group consisting of: a circular cross-section, a square cross-section, and a rectangular cross-section.

It is to be understood that the present invention is not limited to the embodiments described above, but encompasses any and all embodiments within the scope of the following claims.

I claim:

1. A leaf and debris collection member (320*a*), comprising:

top, bottom, front, rear, first, and second sides, said bottom side defining an interior side;

a female vertical stem, said stem extends from a central location on the interior side of said bottom side, said stem defining a bore having opposite open ends;

at least one inward opening front flap is located at said front side; and a plurality of debris and leaf guides, said guides converge and extend from said at least one front flap, wherein said first and second sides define a plurality of male tongues, and said top and bottom sides define complementary female slots, said male tongues and female slots are aligned such that said tongues snap-fit into said complementary female slots.

2. The leaf and debris collection member according to claim 1 in combination with a base, a first vertical support member connected to and extending upward from said base, a horizontal support member connected to and extending outward from said vertical support member, a second vertical support member having proximal and distal opposite ends, said proximal end connected to and extending downward from said horizontal support member, wherein said leaf and debris collection member is attached to said distal end of said second vertical support member.

3. The leaf and debris collection member according to claim 1 in combination with a base, a first vertical support member connected to and extending upward from said base, a horizontal support member connected to and extending outward from said vertical support member, a second vertical support member having proximal and distal opposite ends, said proximal end connected to and extending downward from said horizontal support member, wherein said leaf and debris collection member is attached to said distal end of said second vertical support member, and further wherein said first vertical support member, said second vertical support member and said horizontal support member are made of interchangeable lengths of plastic or aluminum tubing.

4. The leaf and debris collection member according to claim 1 in combination with a base, a first vertical support member connected to and extending upward from said base, a horizontal support member connected to and extending outward from said vertical support member, a second vertical support member having proximal and distal opposite ends, said proximal end connected to and extending downward from said horizontal support member, wherein said leaf and debris collection member is attached to said distal end of said second vertical support member, wherein said first vertical support member, said second vertical support member and said horizontal support member are made of interchangeable lengths of plastic tubing, and further wherein said first vertical support member, said second vertical support member and said horizontal support member have a circular cross-section.

5. The leaf and debris collection member according to claim 1 in combination with a base, a first vertical support member connected to and extending upward from said base, a horizontal support member connected to and extending outward from said vertical support member, a second vertical support member having proximal and distal opposite ends, said proximal end connected to and extending downward from said horizontal support member, wherein said leaf and debris collection member is attached to said distal end of said second vertical support member, wherein said first vertical support member, said second vertical support member and said horizontal support member are made of interchangeable lengths of plastic or aluminum tubing, and further wherein said first vertical support member, said second vertical support member and said horizontal support member have at least one cross-section alone or in combination selected from the group consisting of: a circular cross-section, a square cross-section, and a rectangular cross-section.

* * * * *